US007022653B2

(12) United States Patent
Hartley et al.

(10) Patent No.: US 7,022,653 B2
(45) Date of Patent: Apr. 4, 2006

(54) FRICTION MODIFIERS FOR ENGINE OIL COMPOSITION

(75) Inventors: Rolfe J. Hartley, Rockaway, NJ (US); Michael D. Hoey, Maplewood, NJ (US); Steve Harris, Oxford (GB)

(73) Assignee: Infineum International Limited, (GB)

( * ) Notice: Subject to any disclaimer, the term of this patent is extended or adjusted under 35 U.S.C. 154(b) by 289 days.

(21) Appl. No.: 10/385,312

(22) Filed: Mar. 10, 2003

(65) Prior Publication Data

US 2004/0180798 A1 Sep. 16, 2004

(51) Int. Cl.
*C10M 129/70* (2006.01)
*C10M 141/12* (2006.01)

(52) U.S. Cl. ..... 508/364; 508/476; 508/500

(58) Field of Classification Search ..... 508/476, 508/500, 364
See application file for complete search history.

(56) References Cited

U.S. PATENT DOCUMENTS

| | | | | |
|---|---|---|---|---|
| 2,018,758 | A | 10/1935 | Ellis | 87/9 |
| 2,151,300 | A | 3/1939 | Moran et al. | 87/9 |
| 2,520,356 | A | 8/1950 | Bishop | 117/134 |
| 2,831,813 | A * | 4/1958 | Matuszak et al. | 508/476 |
| 2,951,041 | A | 8/1960 | Saunders | 252/34.7 |
| 3,807,973 | A | 4/1974 | Iwama et al. | 44/7 B |
| 4,002,569 | A * | 1/1977 | Rubin et al. | 508/476 |
| 4,208,293 | A | 6/1980 | Zaweski | 252/51.5 A |
| 4,447,348 | A * | 5/1984 | Forsberg | 252/75 |
| 4,448,703 | A * | 5/1984 | Forsberg | 252/75 |
| 5,023,283 | A * | 6/1991 | Ravichandran et al. | 524/239 |
| 5,198,131 | A * | 3/1993 | Hsu et al. | 508/476 |
| 5,352,377 | A * | 10/1994 | Blain et al. | 508/454 |
| 5,964,907 | A | 10/1999 | Farmer et al. | 44/391 |
| 6,013,115 | A | 1/2000 | Kanakia et al. | 44/391 |
| 6,300,291 | B1 | 10/2001 | Hartley et al. | 508/363 |

FOREIGN PATENT DOCUMENTS

| | | |
|---|---|---|
| WO | WO01/59037 A2 | 8/2001 |
| WO | WO01/59037 A3 | 8/2001 |

* cited by examiner

*Primary Examiner*—Ellen M. McAvoy

(57) ABSTRACT

A lubricating oil composition which exhibits improved fuel economy and fuel economy retention which contains a mono-, di- or triester of a tertiary hydroxyl amine and a fatty acid as a friction modifying fuel economy additive.

10 Claims, No Drawings

FRICTION MODIFIERS FOR ENGINE OIL COMPOSITION

This invention relates to lubricating oils particularly useful for internal combustion engines. More particularly, the invention relates to lubricating oil compositions which exhibit improvements in fuel economy and fuel economy retention through use of certain friction modifiers.

The present invention is based on the discovery that the use of certain fatty acid ester derivatives of tertiary hydroxyamines as friction modifiers can provide increases in fuel economy as well as fuel economy retention for lubricating oils containing these additives.

U.S. Pat. No. 2,951,041, issued Aug. 30, 1960 to Saunders, discloses synthetic lubricants based on alkylene oxide oils which may contain a triethanolamine oleate salt. U.S. Pat. No. 4,208,293, issued Jun. 17, 1980 to Zaweski, discloses lubricating oils for use as a crankcase lubricant which contains a friction reducing amount of a fatty acid ester of diethanolamine. U.S. Pat. No. 2,151,300, issued Mar. 21, 1939 to Moran et al., discloses a lubricating oil which contain the combination of an organic phosphorous ester compound and an amine. Among the amines listed is triethanolamine stearate salt.

In accordance with the invention there has been discovered a lubricating oil composition which comprises an oil of lubricating viscosity and, as a friction modifying fuel economy additive, an effective amount of ester formed as the reaction product of (i) a tertiary amine of the formula $R_1R_2R_3N$ wherein $R_1$, $R_2$ and $R_3$ represent aliphatic hydrocarbyl, preferably alkyl, groups having 1 to 6 carbon atoms, at least one of $R_1$, $R_2$ and $R_3$ having a hydroxyl group, with (ii) a saturated or unsaturated fatty acid having 10 to 30 carbon atoms. Preferably, the tertiary amine will have at least one hydroxyalkyl group having 2 to 4 carbon atoms. The ester may be a mono-, di- or tri-ester or a mixture thereof, depending on how many hydroxyl groups are available for esterification with the acyl group of the fatty acid.

A preferred embodiment comprises a mixture of esters formed as the reaction product of (i) a tertiary hydroxy amine of the formula $R_1R_2R_3N$ wherein $R_1$, $R_2$ and $R_3$ may be a $C_2$–$C_4$ hydroxy alkyl group with (ii) a saturated or unsaturated fatty acid having 10 to 30 carbon atoms, with a mixture of esters so formed comprising at least about 30–60 wt. %, preferably 45–55 wt. % diester, such as about 50 wt. % diester, 10–40 wt. %, preferably 20–30 wt. % monoester, e.g. 25 wt. % monoester, and 10–40 wt. %, preferably 20–70 wt. % triester, such as 25 wt. % triester.

Preferably, the lubricating oil composition of this invention will have a NOACK volatility of about 15 wt. % or less, such as 4–15 wt. %, as measured according to ASTM D5800.

Preferred tertiary hydroxy amines include, but are not limited to, triethanolamine, propanol diethanolamine, ethanol diisopropanolamine, tri-isopropanolamine, dimethyl ethanolamine, diethyl ethanolamine, methyl diethanolamine, ethyl diethanolamine and mixtures thereof. Triethanolamine is particularly preferred.

Suitable fatty acids for forming the ester used in the present invention will have about 10 to 30 carbon atoms and preferably the fatty acid is primarily a $C_{16}$–$C_{22}$ acid, such as oleic, palmitic, erucidic, eicosanic and mixtures thereof. Preferred acids are described by the natural source of the mixture of fatty acids, such as soya fatty acid, soybean fatty acid, tall oil fatty acid, canola fatty acid, sunflower oil fatty acid, cottonseed oil fatty acid, linseed oil fatty acid, palm oil fatty acid, or tallow fatty acid. The most preferred fatty acid is a mixture of tallow/distilled tallow fatty acids having a cis:trans isomer ratio of greater than 9:1.

The esterification of the fatty acids with the tertiary hydroxy amine is carried out at a temperature of about 175–210° C. until the reaction product has an acid value of below 5. The molar ratio of fatty acid to amine is generally in the range of about 1.5–2.6 and preferably in the range of about 1.6–1.8.

The reaction is catalyzed by acids including, but not limited to, sulfonic acid, phosphorous acid, p-toluene sulfonic acid, methane sulfonic acid, oxalic acid, hypophosphorous acid or an acceptable Lewis acid. Typically, 0.02–0.2% by weight, and more preferably, 0.1–0.15% by weight of acid catalyst, based on the weight of the fatty acid is employed in the process to make the ester.

Generally speaking, these friction modifiers are used in lubricating oils in an amount from 0.05 to 2%, preferably 0.02 to 1% and most preferably 0.3 to 0.75% by weight, such as about 0.6% by weight.

A preferred embodiment comprises lubricating oil compositions containing the ester of the invention, especially the aforesaid preferred mixture of mono-, di- and tri-esters, which compositions also contain an organo-molybdenum additive, so as to provide 25 to 1000 ppm, preferably 25 to 100 ppm molybdenum in the finished oil composition (as determined by ASTM D5185).

As an example of such oil soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. In the instance n is 3, 2 or 1, appropriately charged ionic species is required to confer electrical neutrality to the trinuclear molybdenum compound. The ionic species may be of any valence, for example, monovalent or divalent. Further the ionic species may be negatively charged, i.e. an anionic species, or may be positively charged, i.e. a cationic species or a combination of an anion and a cation. Such terms are known to a skilled person in the art. The ionic species may be present in the compound through covalent bonding, i.e. coordinated to one or more molybdenum atoms in the core, or through electrostatic bonding or interaction as in the case of a counter-ion or through a form of bonding intermediate between covalent and electrostatic bonding. Examples of anionic species include disulfide, hydroxide, an alkoxide, an amide and a thiocyanate or derivate thereof; preferably the anionic species is disulfide ion. Examples of cationic species include an ammonium ion and a metal ion, such as an alkali metal, alkaline earth metal or transition metal, ion, preferably an ammonium ion, such as $[NR_4]^+$ where R is independently H or alkyl group, more preferably R is H, i.e. $[NH_4]^+$. At least 21 total carbon atoms should be present among all the ligands' organo groups, such as at least 25, at least 30, or at least 35 carbon atoms.

The ligands are independently selected from the group of

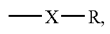

1

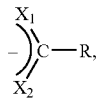

2

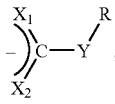

3

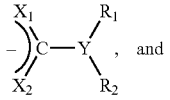

4

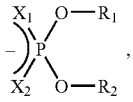

5 and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $MO_3S_kL_nQ_z$ have cationic cores surrounded by anionic ligands and are represented by structures such as

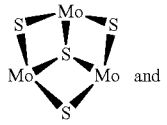

6

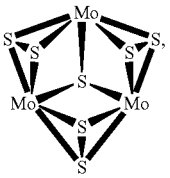

7 and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}\cdot n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}\cdot n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligand's organo groups. Preferably, the ligand source chosen has a sufficient number of carbon atoms in its organo groups to render the compound soluble or dispersible in the lubricating composition.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulfide and mixtures thereof. Most preferably, the molybdenum compound is present as molybdenum dithiocarbamate. The molybdenum compound may also be a trinuclear molybdenum compound.

Natural oils useful as basestocks in this invention include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Alkylene oxide polymers and interpolymers and derivatives thereof where the terminal hydroxyl groups have been modified by esterification, etherification, etc., are a class of known synthetic lubricating oils useful as basestocks in this invention. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils useful in this invention comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dicicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tertbutylphenyl) silicate, hexa-(4-methyl-2-pentoxy) disiloxane, poly(methyl) siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improved one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The compositions of this invention are principally used in the formulation of crankcase lubricating oils for passenger car engines, preferably compositions having a major amount of a mineral oil basestock of lubricating viscosity. The additives listed below (including any additional friction modifiers) are typically used in such amounts so as to provide their normal attendant functions. Typical amounts for individual components are also set forth below. All the values listed are stated as mass percent active ingredient in the total lubricating oil composition.

| ADDITIVE | MASS % (Broad) | MASS % (Preferred) |
|---|---|---|
| Ashless Dispersant | 0.1–20 | 1–8 |
| Metal Detergents | 0.1–15 | 0.2–9 |
| Corrosion Inhibitors | 0–5 | 0–1.5 |
| Metal Dihydrocarbyl Dithiophosphate | 0.1–6 | 0.1–4 |
| Anti-oxidant | 0–5 | 0.01–3 |
| Pour Point Depressant | 0.01–5 | 0.01–1.5 |
| Anti-foaming Agent | 0–5 | 0.001–0.15 |
| Supplemental Anti-wear Agents | 0–5 | 0–2 |
| Additional Friction Modifier | 0–5 | 0–1.5 |
| Viscosity Modifier | 0–6 | 0.01–4 |

The individual additives may be incorporated into a basestock in any convenient way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is conveniently made in accordance with the method described in U.S. Pat. No. 4,938,880. That patent describes making a pre-mix of ashless dispersant and metal detergents that is pre-blended at a temperature of at least about 200° C. Thereafter, the pre-mix is cooled to at least 85° C. and the additional components are added.

The final crankcase lubricating oil formulation may employ from 2 to 20 mass % and preferably 4 to 15 mass % of the concentrate of additive package with the remainder being base stock.

Ashless dispersants maintain in suspension oil insolubles resulting from oxidation of the oil during wear or combustion. They are particularly advantageous for preventing the precipitation of sludge and the formation of varnish, particularly in gasoline engines.

Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyanine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is an $\alpha,\omega$-diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400–2500, preferably 950–2200) succinimide dispersants.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic ester, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents may be present and these function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Other friction modifiers include oil soluble amines, amides; imidazolines, amine oxides, amidoamines, nitrites, alkanolamides, alkoxylated amines and ether amines and polyol esters, esters of polycarboxylic acids, molybdenum compounds and the like.

Detergents that may be used include oil-soluble neutral and overbased sulfonates, phenates, sulfurized phenates, thiophosphonates, salicylates, and naphthenates and other oil-soluble carboxylates of a metal, particularly the alkali, e.g., sodium, potassium, lithium and magnesium. Preferred are neutral or overbased calcium and magnesium phenates and sulfonates, especially calcium.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts (ZDDP) are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

ZDDP provides excellent wear protection at a comparatively low cost and also functions as an antioxidant. However, there is some evidence that phosphorus in lubricant can shorten the effective life of automotive emission catalysts. Accordingly, industry has limited the amount of phosphorus that lubricants can contain. The proposed category (ILSAC GF-4) is expected to require not more than 0.08 wt. % P and 0.5 wt. % S in the finished oil, and it is expected that future categories will require that the phosphorus content of lubricants be further reduced to 0.06 wt. % or less. The compositions of this invention preferably contain not more than 0.08 wt. % P and not more than 0.5 wt. % S in the finished oil (test method ASTM D5185).

Oxidation inhibitors or antioxidants reduce the tendency of basestocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oils soluble phenates and sulfurized phenates, phosphosulfurized or sulfurized hydrocarbons, phosphorous esters, metal thiocarbamates, oil soluble copper compound as described in U.S. Pat. No. 4,867,890, and molybdenum containing compounds.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4-thiadiazoles such as those described in U.S. Pat. Nos. 2,719,125; 2,719,126; and 3,087,932; are typical. Other similar material are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in U.K. Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil improvers, lower the minimum temperature at which the fluid will flow or can be poured. Such additives are well known. Typical of those additives which improve the low temperature fluidity of the fluid are $C_8$ and $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The invention is further illustrated by the following examples which are not to be considered as limitative of its scope. All percentages are by weight active ingredient content of an additive without regard for carrier or diluent oil.

EXAMPLE 1

The following 5W-20 crankcase oil was prepared and tested in the ASTM Sequence VIB test which measures fuel economy improvement versus a baseline calibration oil after 16 hours of aging (Phase I) and after 96 hours of aging (Phase II or retained fuel economy). Oil A contained no fuel economy additive, Oil B contained 0.30% of a mixture of an ethoxylated amine and a polyol ester as the fuel economy additive, Oil C contained 0.60% of the same polyol ester as the fuel economy additive and Oil D contained 0.60% of the ester mixture of the invention prepared from tallow acid and triethanolamine and containing 50 wt. % diester, 25 wt. % triester and 25 wt. % monoester.

Oil A

| | Wt. % |
|---|---|
| Dispersant | 2.500 |
| Antifoam Agent | 0.001 |
| Calcium Sulfonate (TBN 300) | 0.880 |
| Calcium Sulfonate (TBN 26) | 0.470 |
| Phenolic Antioxidant | 0.900 |
| Anti-wear Additives | 0.781 |
| Viscosity Modifier | 0.790 |
| Mineral Oil Base Stocks | Balance |

Each of Oil A, B, C and D has a phosphorus content of 0.06% and a NOACK volatility less than 15%.

Sequence VIB - Fuel Economy Improvement

| | Oil A | Oil B | Oil C | Oil D |
|---|---|---|---|---|
| Phase I | 1.06% | 1.89% | 1.58% | 1.83% |
| Phase II | 1.13% | 1.13% | 1.38% | 1.64% |

EXAMPLE 2

Oils E, F and G were prepared. Each oil had 50 ppm molybdenum present as trinuclear molybdenum dithiocarbamate, an anti-wear additive. Oil E was otherwise the same as Oil B, Oil F was otherwise the same as Oil C except that 0.3 wt. % of the polyol ester fuel economy additive was present and Oil G was otherwise the same as Oil D except that 0.3 wt. % of the ester mixture was present. Coefficient of friction data was collected for each oil. The data shows the desirable cooperative effect on fuel economy obtained when the fuel economy additive of the invention is used in combination with an organo molybdenum additive.

A high frequency reciprocating rig (HFRR) was used to evaluate the coefficent of friction characteristics of oils E, F and G. The instrument is called the AUTOHFR and is manufactured by PCS Instruments. The test protocol is shown in the table below.

HFRR Protocol

| | |
|---|---|
| Contact | 6 mm. Ball on 10 mm. Disc |
| Load, N | 3.9 |
| Stroke Length, Mm | 1 |
| Frequency, Hz. | 20 |
| Temperature, ° C. | 100 |
| Time per Stage, min. | 60 |

HFRR Coefficient of Friction @ 100° C.

| Time, min. | Oil E | Oil F | Oil G |
|---|---|---|---|
| 5 | 0.12 | 0.14 | 0.15 |
| 10 | 0.12 | 0.14 | 0.15 |
| 15 | 0.13 | 0.14 | 0.15 |
| 20 | 0.13 | 0.14 | 0.10 |

-continued

| HFRR Coefficient of Friction @ 100° C. | | | |
|---|---|---|---|
| Time, min. | Oil E | Oil F | Oil G |
| 25 | 0.13 | 0.14 | 0.10 |
| 30 | 0.13 | 0.14 | 0.10 |
| 35 | 0.13 | 0.14 | 0.09 |
| 40 | 0.13 | 0.14 | 0.09 |
| 45 | 0.13 | 0.14 | 0.09 |
| 50 | 0.14 | 0.13 | 0.11 |
| 55 | 0.13 | 0.13 | 0.09 |
| 60 | 0.14 | 0.13 | 0.10 |

What is claimed is:

1. A lubricating oil composition which comprises an oil of lubricating viscosity and, as a friction modifying fuel economy additive, an effective amount of ester formed as the reaction product of (i) a tertiary amine of the formula $R_1R_2R_3N$ wherein $R_1$, $R_2$ and $R_3$ represent aliphatic hydrocarbyl groups having 1 to 6 carbon atoms, at least one of $R_1$, $R_2$ and $R_3$ having a hydroxyl group with (ii) a saturated or unsaturated fatty acid having 10 to 30 carbon atoms wherein the ester is a mixture of mono-, di and tri-esters, the mixture comprising about 30–60 wt. % diester, 10–40 wt. % monoester and 10–40 wt. % triester and wherein each of $R_1$, $R_2$ and $R_3$ is a $C_2$–$C_4$ hydroxyalkyl group.

2. The composition of claim 1 wherein at least one of $R_1R_2$ and $R_3$ is an alkyl group.

3. The composition of claim 1 which has not more than 0.08 wt. % P and a NOACK volatility less than 15 wt.%.

4. The composition of claim 1 wherein there is present 0.05 to 2.0 wt. % of the ester.

5. The composition of claim 1 wherein the tertiary amine is triethanolamine.

6. The composition of claim 1 wherein the fatty acid has 16 to 22 carbon atoms.

7. The composition of claim 1 wherein the fatty acid is tallow fatty acid.

8. The composition of claim 1 further comprising an organo-molybdenum additive in an amount providing 25 to 1000 ppm molybdenum in the composition.

9. The composition of claim 8 wherein there is present 25 to 100 ppm molybdenum.

10. The composition of claim 9 wherein the organo-molybdenum additive is a trinuclear molybdenum dithiocarbamate.

* * * * *